United States Patent [19]

Wittek

[11] Patent Number: 4,859,103

[45] Date of Patent: Aug. 22, 1989

[54] SELF-SEALING RETRACTABLE WRITING IMPLEMENT

[76] Inventor: Gotz U. Wittek, Giselastr.3, Munich 40, Fed. Rep. of Germany, D-8000

[21] Appl. No.: 10,164

[22] PCT Filed: May 20, 1986

[86] PCT No.: PCT/EP86/00306

§ 371 Date: Mar. 16, 1987

§ 102(e) Date: Mar. 16, 1987

[87] PCT Pub. No.: WO86/07014

PCT Pub. Date: Dec. 4, 1986

[30] Foreign Application Priority Data

May 20, 1985 [DE] Fed. Rep. of Germany ..... 3518069

[51] Int. Cl.[4] ..... B43K 24/16; B43K 24/08

[52] U.S. Cl. ..... 401/108; 401/111; 401/115

[58] Field of Search ..... 401/59, 107, 108, 109, 401/110, 111, 112, 115, 65

[56] References Cited

U.S. PATENT DOCUMENTS

| | | | |
|---|---|---|---|
| 290,684 | 12/1883 | Hoffman | 401/115 |
| 2,111,767 | 3/1938 | Gimonet | 401/59 |
| 3,196,839 | 7/1965 | Bertoglio et al. | 401/112 |
| 3,362,778 | 1/1968 | Pavese | 401/107 |
| 3,480,370 | 11/1969 | Koeln | 401/107 |
| 4,533,272 | 8/1965 | Sakai | 401/107 |
| 4,540,300 | 9/1985 | Midorikawa | 401/107 |

FOREIGN PATENT DOCUMENTS

| | | | |
|---|---|---|---|
| 964025 | 7/1950 | France | 401/115 |
| 505158 | 12/1954 | Italy | 401/115 |
| 728956 | 12/1966 | Italy | 401/65 |

*Primary Examiner*—Richard J. Apley
*Assistant Examiner*—David J. Bender
*Attorney, Agent, or Firm*—Handal & Morofsky

[57] ABSTRACT

A writing implement including a sleeve-shaped housing and an automatic closure mechanism for the nib. The actuating element has a shift mechanism 3', the spring 10 biasing the writing element 2 against the housing bears on the inner sleeve 104, that the shift mechanism 3' engages the outer sleeve assembly 41, that the return force of the spring 10 biasing the writing element 2 against the inner sleeve 104 is smaller than that of a spring 9 which biases the inner sleeve 104 against the outer sleeve assembly 41. Additionally the actuating element consists of two actuating members displaceable axially with respect to each other, of which the first actuating member 120 acts on the intermediate sleeve 104 and the second actuating member 108 acts on the writing element 2, carries the shift mechanism 3' and is actuated by the first actuating member 120.

5 Claims, 2 Drawing Sheets

SELF-SEALING RETRACTABLE WRITING IMPLEMENT

FIELD OF THE INVENTION

This case incorporates by reference pending related U.S. application Ser. No. 159,449 which is a continuation of U.S. application Ser. No. 762,196, now abandoned.

The invention relates to a writing implement comprising a sleeve-shaped housing and a writing element which is disposed in said housing and which is displaceable between a writing readiness position freeing the tip portion of the writing element serving for writing and a storage position retracted into the housing, the housing portion adjacent the tip portion of the writing element consisting of segments which in the writing readiness position are radially spread apart and in the storage position bear on each other and form a closure portion for the tip, the housing consisting of an outer sleeve and an inner sleeve which is disposed substantially within the outer sleeve relatively displaceable with respect to the latter in the axial direction to a limited extent and the segments forming the closure portion of the housing are mounted on the inner sleeve, project radially outwardly under biasing and lie partially outside the outer sleeve where they have a greater external diameter than the internal width of the tip-side end of the outer sleeve, the inner sleeve being biased via a spring bearing on the outer sleeve in the direction towards the storage position and axially displaceable by means of an actuating element against the pressure of the spring .

The invention is based on the problem of improving such a writing implement in such a manner that its production and actuation is further facilitated.

SUMMARY OF THE INVENTION

This problem is solved according to the invention in that the actuating element comprises a shift mechanism, that the spring biasing the writing element against the housing bears on the inner sleeve, that the shift mechanism engages the outer sleeve, that the return force of the spring biasing the writing element against the inner sleeve is smaller than that of the spring which biases the inner sleeve against the outer sleeve and that the actuating element consists of two elements which are axially displaceable with respect to each other and of which the first acts on the intermediate sleeve and the second acts on the writing element, carries the shift mechanism and is actuated by the first element.

Advantageously, the two elements of the actuating element have a substantially complementary form and have together substantially the form of a cylinder.

A further improvement of the writing implement according to the invention is achieved in that the segments have on their inner side in the region enclosing the tip portion in each of which correspondingly formed resilient sealing shells are secured which in the storage position engage on each other and form together a hermetically sealed chamber surrounding the tip portion. This configuration makes it possible to produce with simplest means a hermetic sealing chamber around the nib when the writing implement is in the storage position.

To obtain a greater flexibility of the segments the latter are preferably mounted via tapered web regions on the inner sleeve.

BRIEF DESCSRIPTION OF THE DRAWINGS

Hereinafter the invention will be described in detail with reference to the drawings, wherein:

FIG. 1–1*b* shows longitudinal sections through the embodiment of the writing implement in the rest, shift and writing phase, FIG. 2 is an enlarged plan view of one of the two semi-shell-shaped intermediate sleeves 104 of the writing implement of FIGS. 1–1*b*, FIG. 3 is an enlarged plan view of a sealing shell 99 of the writing implement, FIG. 4 is an enlarged longitudinal section through the pushbutton 101 of the writing implement, FIG. 5 is an enlarged cross-section along line 5—5 through the closed closure tip of the writing implement of FIG. 1, FIG. 6 is a further enlarged cross-section along line 6—6 through the closed closure tip of the writing implement of FIG. 1, FIG. 7 is an enlarged cross-section along line 7—7 through the opened closure tip of the writing implement of FIG. 1*b*, FIG. 8 is an enlarged cross-section through the pushbutton 101 of the writing implement, FIG. 9 is a further enlarged cross-section through the pushbutton of the writing implement, FIG. 10 is an enlarged cross-section through the rear shift region of the writing implement of FIG. 1.

DESCRIPTION OF THE PREFERRED EMBODIMENT

Figure 1:
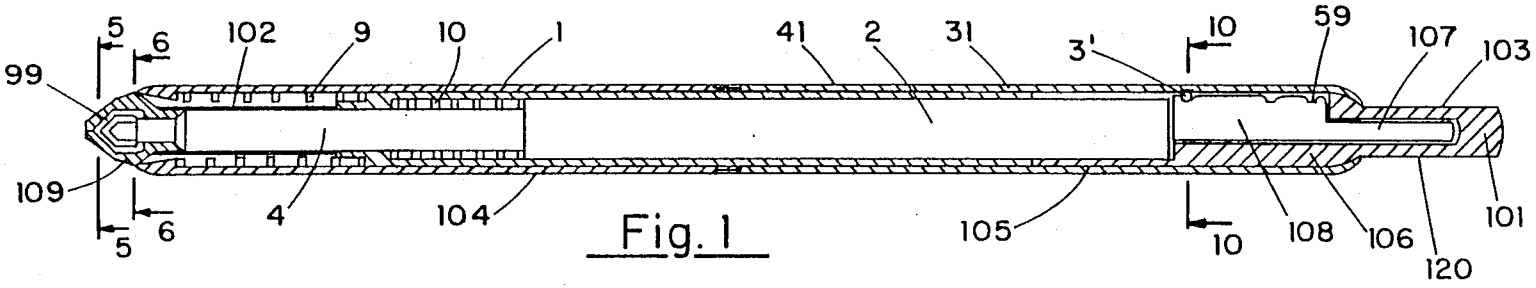

The example of embodiment of the writing implement illustrated in FIGS. 1 to 10 comprises a preferably two-part sleeve-shaped housing 41 and an intermediate sleeve 104 which is arranged therein and preferably consists of two half shells welded together at the back. The half shells are each provided at their front side with a bend-up web 102 and a pressure shell 109 disposed thereon. The pressure shell 109 serves preferably as support of a resilient sealing shell 99 connected fixed thereto. Furthermore, in the intermediate sleeve 104 a writing element 2 is disposed which is biased at the front with a weak spring 10. In the two sealing shells 99 of the intermediate sleeve 104 in the closure state (FIG. 1) the nib 26 of the writing element 2 is hermetically sealed, this being done so firmly that the evaporation pressure of all known writing agents and solvents are sealed with absolute certainty. The closure pressure produced by a very strong spring 9 is moreover so high that any writing liquid running out into the closed sealing shells cannot under any circumstances penetrate to the outside by capillary action.

Furthermore, in the rear portion of the writing implement a partially shell-shaped pushbutton element 101 is disposed whose partial shell regions 105 and 106 (FIGS. 1, 4, 8, 9 and 10) extend up to the rear end of the intermediate sleeve 104 and can act on the latter (FIG. 1). In the region which is not filled at the back by the pushbutton element 101 there is also a shift member 108 with a shift mechanism 3' engaging the housing 31 which can act on the writing element 2 and can be entrained by the pushbutton element 101.

In other examples of embodiment of the writing implement not illustrated the closure 109, 102, 99 can be made in three or more parts to achieve a symmetrical form during the writing condition. Furthermore, for securing the sealing shells 99 advantageously a plurality of grooves and flutes may be present on the pressure shells 109 which permit a fixed clamping or engagement of the sealing materials or shells 99 on the pressure shells 109 without adhesive, vulcanizing or other techniques being necessary.

Furthermore, in the production of other advantageous examples of embodiment of the writing implement it is possible to achieve the connection of the sealing region with the actual closure parts, e.g. the closure shell 109 or the like, by a two-component injection molding, by pressing on or spraying on sealing material, by partial immersion of the closure in sealing materials or by pressing in or fitting on a sealing shell element onto closure elements interengaging in corresponding manner therewith.

The example of embodiment illustrated (FIGS. 1 to 10) resembles in its functions substantially an example of embodiment of earlier U.S. application Ser. No. 762,196, which which is shown therein in FIGS. 3 to 6. However, this represents a maximum simplification as regards the admittedly extremely advantageous but very complicated control and shift mechanism and as regards the nature of the hermetic all-round seal.

The great technical advantage in the previous example of embodiment was that in contrast to all the other examples of embodiments of the same application the strong pressure spring acted on the closure and the weak pressure spring on the shift mechanism. Reaching the writing readiness position was controlled therein in that the pushbutton acts both directly on the intermediate sleeve and directly on the writing element, the writing element remaining through longitudinal slots in the intermediate sleeve in connection with a shift mechanism engaging the outer sleeve. Said mechanism shifts during the advance outside the intermediate sleeve, the writing element thus remaining in the advanced position, whereafter the closure retracts and frees the nib.

Figure 1A:
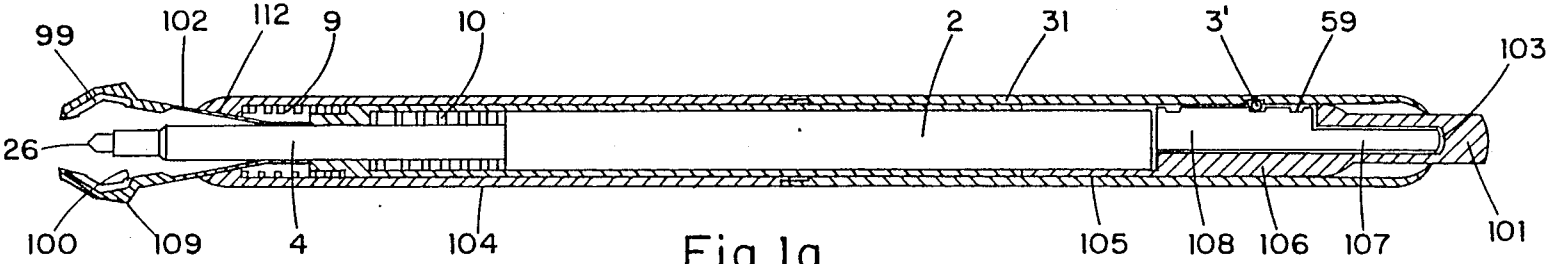
Figure 1B:
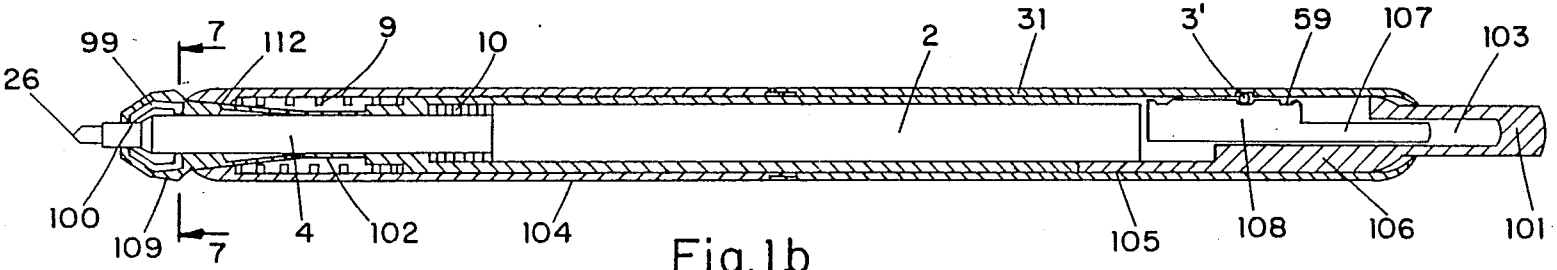

The complicated shifting through the intermediate sleeve is solved in the present example of embodiment (FIGS. 1 to 10) in that the rear actuating member 120 comprising pushbutton 101 (FIG. 1) is made in certain regions 105, 106 (FIGS. 1, 4, 8, 9) only in partial shell form and in these regions 106 and 105 acts on the intermediate sleeve 104 (FIGS. 1–1*b*). Simultaneously, the pushbutton 101 acts in the region remaining free through the partial shells 106 and 105 on a particularly longitudinally displaceable shaft member 108 having a lateral shift mechanism 3' engaging on the rear housing portion 31 (said shift mechanism preferably being a conventional cam with free-running ball) (FIGS. 1–1*b* and FIG. 10), said shift member 108 in turn acting on the writing element 2.

Now, on actuation of the pushbutton 101 both the intermediate sleeve 104 with the closure 109, 99, 102 is pushed forwardly against the pressure of the spring 9 by the pushbutton region 105 and the writing element 2 is pushed forwardly via the shift member 108.

This pressure actuation continues until the shift member 108 switches over with the lateral shift mechanism 3' at the point 59, whereafter the pressure actuation relaxes and the shift mechanism 3' engages with the writing element 2 in the advanced position (FIG. 1*a*) and is fixed there by the spring 10.

By further reduction of the actuating pressure, the intermediate sleeve 104 with the rear actuating member 120 the front closure 109, 99, 102 now moves further to the rear and finally exposes the nib 26 and the writing element tip portion 4 is clamped by corresponding fixed shoulders 112 of the pressure shells 109 without the sealing shells 99 being contacted whilst the spring 9 is relaxed and the spring 10 tensioned (FIG. 1*b*).

To prevent a lateral tilting and dropping out of the shift member 108 and thus possibly also the pushbutton 101 out of the rear housing portion 31 during the screwed-on state, the shift member 108 is additionally held via a rear extension 107 in a recess 103 of the pushbutton 101. This guarantees that even when the shift member 108 is pushed forwardly to a maximum extent against the pushbutton 101 the latter is still held exactly in the axis-parallel position and thus at the latest at the changeover point 59 is secured by the shift ball, the pushbutton 101, once mounted, thereby being permanently retained in the rear housing portion 31. The pushbutton 101 and the shift mechanism 108 adapted exactly thereto thus form a fixed functional unit after assembly.

On closure of the writing implement the function sequences described take place in the reverse order.

Figure 2:
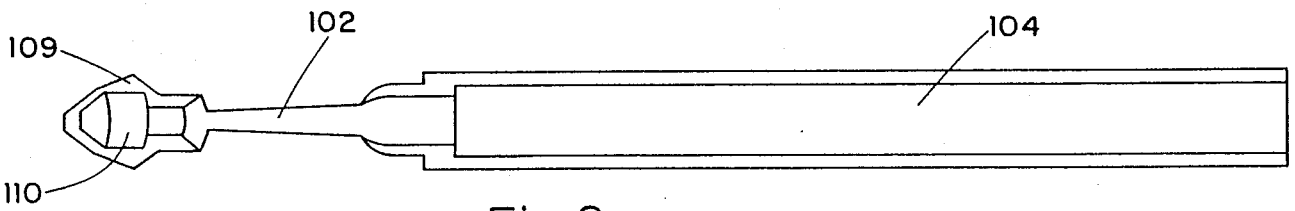
Figure 4:
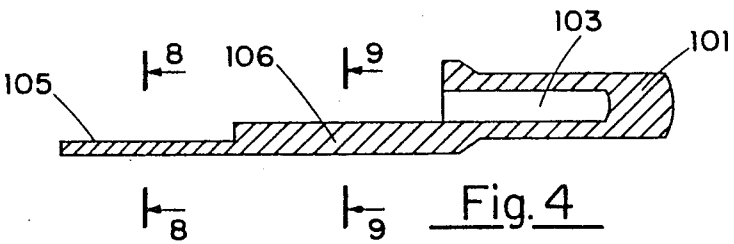
Figure 3:
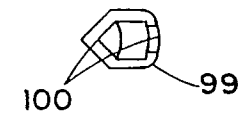
Figure 10:
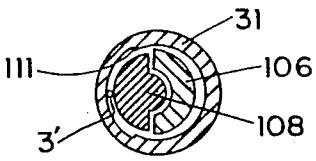
Figures 8, 9:
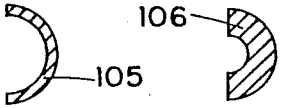
Figure 7:
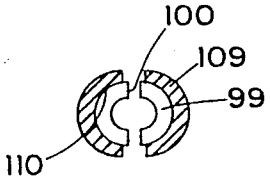

The hermetic closure of the nib 26 could also be simplified and simultaneously made perfect in the present example of embodiment in that all the sealing functions outwardly and inwardly are fulfilled solely by a sealing shell 99 (in the present case thus a total of two) fixedly connected with each pressure shell 109 (FIGS. 1 and 2).

Figure 6:
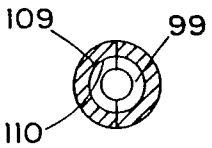
Figure 5:
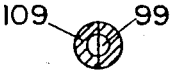

The sealing shell 99 is accommodated in a correspondingly formed holder 110 of the pressure (half) shell 109 (FIGS. 2 and 3) and fixed, the edge regions 100 of the resilient sealing shell 99 projecting somewhat beyond the edge of the sealing shell 109 (FIG. 7) to ensure that the necessary closure pressure is exerted on the seal joints during the closure (FIGS. 1, 5 and 6). Since a half-shell bending element would have very little flexural elasticity, in this case the bending elements 102 of the closure 109 and 99 have been formed to narrow elastic webs.

I claim:

1. Writing implement comprising:

(a) a sleeve-shaped housing comprising an inner sleeve which is disposed substantially within an outer sleeve, said inner sleeve mounted to be relatively displaceable with respect to said outer sleeve in the axial direction to a limited extent, a plurality of segments mounted on the inner sleeve, said segments being, in a writing readiness position, radially spread apart, and in a storage position bearing on each other to form a closure portion of said housing, said segments projecting radially outwardly under biasing and lying partially outside the outer sleeve where said segments have a greater external diameter than the internal diameter of the closure portion end of the outer sleeve, the inner sleeve being biased via a first spring bearing on the outer sleeve in a direction towards the storage position;

(b) a writing element disposed within said housing, said writing element being displaceable between the writing readiness position freeing the tip portion of the writing element, and the storage position wherein said writing element is retracted protecting said tip within said closure portion;

(c) a second spring, bearing against said inner sleeve and said writing element, said second spring requiring a smaller return force than said first spring; and (d) an actuating element comprising a shift mechanism in engagement with the outer sleeve and two actuating members , said actuating members being axially displaceable with respect to each other and of which a first actuating member acts on the inner sleeve and the second actuating member acts on the writing element, said writing element being biased against said second actuating member by said second spring, said second actuating member also carr ying said shift mechanism and being actuated by said first element.

2. Writing implement according to claim 1, characterized in that the two actuating members (101,105,106) and (107,108) of the actuating element have a form substantially complementary to each other and together have substantially the form of a cylinder whose diameter corresponds substantially to the internal diameter of the outer sleeve (31).

3. Writing implement as claimed in claim 2, wherein said first actuating member consists of three stepped regions of which the first region, which is the region in which said first actuating member is actuated, is rotationally symmetrical and has an axial recess into which an axial projection of the second actuating member engages, the second region is made substantially half-dish shaped and engages around a portion of the second element, and the third region has substantially the form of the second region but a reduced wall thickness, the free end edge of the third portion acting on the inner sleeve .

4. A writing implement as in claim 1 wherein on the inner side of said segments in the region enclosing the tip portion correspondingly formed resilient sealing shells are secure, said shells in the storage position, engage upon each other and form a hermetically sealed chamber surrounding said tip portion.

5. A writing implement as in claim 1 wherein said segments are mounted via tapered web regions on the inner sleeve.

* * * * *